US006045466A

United States Patent [19]

Suess

[11] Patent Number: 6,045,466

[45] Date of Patent: Apr. 4, 2000

[54] FOOTBALL GAME FOR REDUCED SIZE PLAYING AREAS, ESPECIALLY INDOOR PLAYING AREAS

[76] Inventor: Richard F. Suess, 636 W. Idaho Ave., Meridian, Id. 83642

[21] Appl. No.: 09/174,975

[22] Filed: Oct. 19, 1998

[51] Int. Cl.[7] ..... A63B 67/00

[52] U.S. Cl. ..... 473/470; 273/410; 273/477; 273/439

[58] Field of Search ..... 473/470, 438, 473/439, 434, 435, 477, 482, FOR 124, FOR 128, FOR 212, 415, 422, 446, 462, 469, 476; 273/410, 108.1, 108.4, 108, 317.5, 348; 434/251; 52/6

[56] References Cited

U.S. PATENT DOCUMENTS

| | | |
|---|---|---|
| 1,116,459 | 11/1914 | McDonald . |
| 3,865,371 | 2/1975 | Theriot . |
| 4,023,798 | 5/1977 | Pronin . |
| 4,426,080 | 1/1984 | Stokes . |
| 4,911,443 | 3/1990 | Foster . |
| 5,160,138 | 11/1992 | Sanders . |

FOREIGN PATENT DOCUMENTS

| | | | |
|---|---|---|---|
| 002916262 | 10/1980 | Germany | 473/FOR 212 |

*Primary Examiner*—Sebastiano Passaniti
*Attorney, Agent, or Firm*—Jesse D. Lambert

[57] ABSTRACT

Football game for reduced size playing areas, especially indoor playing areas. The invention comprises providing a playing field measuring approximately 198 feet long by 84 feet wide, having markings thereon indicating boundaries, end zones and yardage markers. Two opposing teams, each comprising eight members, attempt to advance a football into the opposing team's end zone to score. The various rules of play of the present invention render it amenable to play in a reduced size setting. In addition to the side and end boundaries of the playing field, overhead boundary surfaces may be provided which restrict the height above the playing field which passed or kicked balls may travel, without striking the upper boundaries and becoming a dead ball. The upper boundary surfaces may comprise at least one vertically hanging flexible surface, such as heavy netting, suspended over the central portion of the field.

12 Claims, 4 Drawing Sheets

FOOTBALL GAME FOR REDUCED SIZE PLAYING AREAS, ESPECIALLY INDOOR PLAYING AREAS

BACKGROUND

1. Field of the Invention

The subject invention relates generally to a method for playing a game or sport having certain similarities to American football, but with novel differences tailored to permit playing the game on a reduced size playing area. More particularly, the present invention relates to a fast-paced, high-scoring, football game that can be played in facilities smaller in size than those typically used by the National Football League ("NFL") and National Collegiate Athletic Association ("NCAA"), and which is particularly suited for play in many existing indoor sports facilities.

2. Description of Related Art

The birthdate of American football is generally regarded by football historians as Nov. 6, 1869, when teams from Rutgers and Princeton Universities met in New Brunswick, N.J., for the first intercollegiate football game. Following the inaugural game in 1869, college football soon became a popular American team sport in its own right.

Professional football first appeared in the United States in about 1895 in the town of Latrobe, Pa., where a team representing Latrobe took the field against a team from Jeannette, Pa. Twenty-five years later, the first league of professional football teams was formed. This inaugural league, the American Professional Football Association, gave way to the National Football League ("NFL") in 1922.

Presently, football at both the college and professional levels is an immensely popular spectator sport in the United States. With the exception of some minor changes, both sports have remained essentially unchanged over the years.

Generally speaking, college and professional football is played on a playing field having a width of 160 feet and a length of 360 feet, which length includes a ten-yard (or 30 foot) end zone at each end. The game is played by two opposing teams, each fielding eleven players at any given time. The opposing teams are designated as the team on offense (the team in possession of the ball) and the team on defense (the team defending a goal line against the team on offense). The team on offense tries to move the ball down the field to score in the end zone defended by the team on defense. The object of the game is to score more points than the opposing team within the designated playing time. Although a few indoor facilities exist which are large enough to accommodate college and professional football games, the size of the requisite playing field for these two games necessitates a very large enclosed stadium and precludes indoor play in most covered facilities, which can otherwise easily accommodate basketball, indoor hockey, indoor soccer and the like.

In professional and collegiate football, the eleven players of the team on offense are divided into two groups: seven linemen, who play on the line of scrimmage (an imaginary line designating the position of the ball) and a backfield of four players, called backs, who stand in various positions behind the linemen. The lineman whose position is in the middle of the line is called the center. The back who usually stands directly behind the center and directs the play of the team on offense is known as the quarterback.

The team on defense consists of a row of linemen, a row of linebackers, and a collection of defensive backs, known as the secondary. Defensive linemen principally are responsible for stopping the opposition's running attack and, in passing situations, putting pressure on the quarterback. The linebackers line up behind the defensive line and, depending on the situation, are used to stop the run attack, pressure the quarterback, or cover the opposition's receivers. The secondary is comprised of cornerbacks, who cover wide receivers, and safeties, who cover receivers, offer support in stopping the rushing attack, and pressure the quarterback.

At the start of each game, the ball is put in play by a place-kick from the kicking team's 30-yard line. The kicking team lines up at or behind the ball, while the opponents spread out over their territory in a formation devised to help them to catch the ball and run it back effectively. If the kick stays within the boundaries of the field, any player on the receiving team may catch the ball, or pick it up on a bounce, and run with it. As the player runs, the player may be tackled by any opponent and stopped. This is known as being downed.

Play resumes as the team on offense gathers in a circle, called a huddle, and discusses the next play it will use to try to advance the ball. The team on defense also forms a huddle and discusses its next attempt to slow the offense. After the teams come out of their respective huddles, they line up opposite each other on the line of scrimmage.

Play begins when the center crouches over the ball and snaps it to the quarterback. The quarterback can pass the ball, hand it off to a teammate, or run with it himself. The offensive players bump the defenders, or try to force them out of the way, by performing a maneuver known as blocking. The defending team tries to prevent the team on offense from advancing the ball by tackling the ball carrier as quickly as possible.

The offense must advance the ball at least ten yards in four tries, called downs. After each play, the teams line up again and a new play takes place. If the team on offense fails to travel ten yards in four downs, it must surrender the ball to its opponent after the fourth down. A team will often punt on fourth down if it has not gained at least ten yards in its previous three tries. By punting, a team can send the ball farther away from its own end zone before surrendering it, thus weakening the opponent's field position.

A team scores a touchdown when one of its players carries the ball into the opposing team's end zone or catches a pass in the end zone. A touchdown is worth six points. After a team has scored a touchdown, it tries for an extra-point conversion. This is an opportunity to score an additional one or two points with no time elapsing off the game clock. A running or passing conversion in which the ball crosses the goal line counts for two points. A place-kick between the goalposts and over the crossbar counts for one point. The goalposts are eighteen feet, six inches wide and the top face of the crossbar is ten feet above the ground.

On offense, teams may also attempt to score by kicking a field goal between the goalposts and over the crossbar. A field goal counts for three points. A field goal is scored by means of a place-kick, in which one player holds the ball upright on the ground for a teammate to kick. The team on defense can also score two points for a safety when it causes the team on offense to end a play in possession of the ball behind its own goal line. The team having the most points at the end of the designated playing time is deemed the winner of the game.

Variations of traditional American football exist. An example is U.S. Pat. No. 4,911,433 to Foster, which discloses an apparatus and method for a variation of traditional American football. Substantially the same rules as American football (e.g., NFL or NCAA) are used in the game of the Foster patent, except that kicks or passes into the end zone may be deflected back onto the playing field as a "live" ball by rebounding assemblies at either end of the playing field that are proximate to the goal line, but elevated above the playing field.

Another variation of traditional American football is disclosed in U.S. Pat. No. 5,207,433 to Moore, which discloses a football game (which may be either a contact- or non-contact game) which primarily employs the passing aspects of traditional American football. Moore discloses a game played on a playing field measuring forty yards long and thirty yards wide with baskets or nets located on the playing field at fixed positions from the line of scrimmage. One player serves as the offensive quarterback and the remaining players serve as defensive players whose primary purpose is to prevent the quarterback from successfully passing into one of the baskets or nets. One of several stated objects of the invention disclosed in Moore is to provide a football passing game which can be played by three to five players of widely varying ages, and to provide a fast-paced game which utilizes the most challenging aspects of the passing game, while mitigating the severe physical contact of traditional American football.

SUMMARY OF THE INVENTION

An object of the present invention is to provide a unique and novel football game which is exciting and enjoyable to watch, and is especially suitable for play in sporting facilities that are smaller in size than typical NFL and NCAA football stadiums; in particular, the football game of the present invention may be played in many existing indoor sporting facilities capable of accommodating basketball, indoor hockey, indoor soccer and the like.

Another object of the present invention is to provide a fast-paced, high-scoring football game that can readily be played in facilities where spectators are in close proximity to the action.

A further object of the present invention is to provide a spectator sport similar to college and professional football that can be played in smaller facilities to enable a larger number of sports fans, who may not be able or willing to travel long distances to attend college or professional football games, to experience the excitement of a live football sporting event.

The present invention comprises a unique and novel game which provides a football game which conforms to various rules of play and field and equipment layout which permits play on a smaller field, as is set forth more fully in the ensuing description.

DESCRIPTION OF THE PREFERRED EMBODIMENT

Although many specificities of the preferred embodiment of the game of the present invention will be described herein, it is to be understood that such specificities are representative only and not to be construed in a limiting sense. In particular, different embodiments of the playing field, the rules of play, and associated regulations are permissible without departing from the spirit and scope of the invention.

Playing Field and Associated Playing Apparatus

Figure 1:
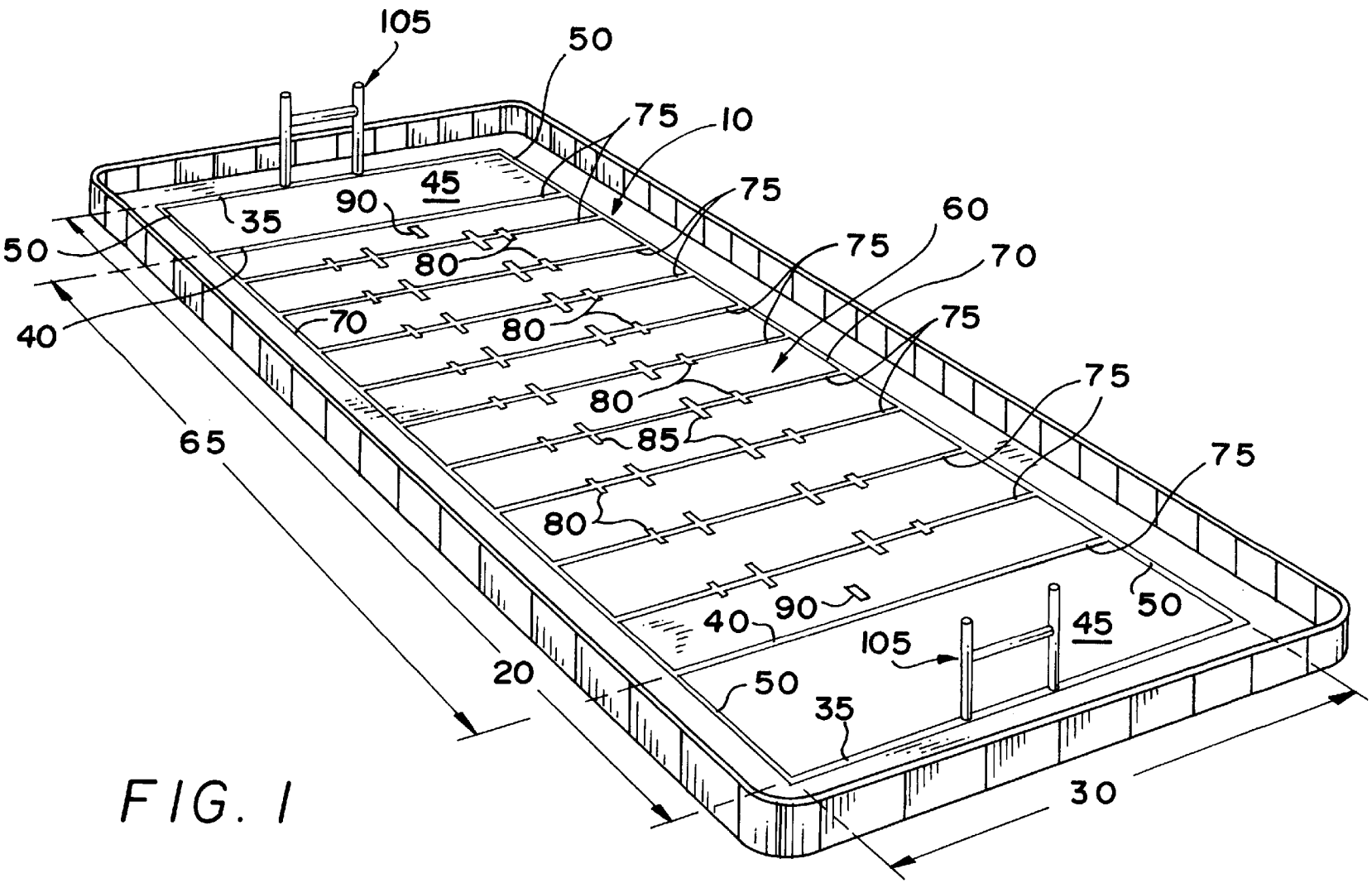
FIG. 1 is a perspective view of the playing field and goalposts.
Figure 2:
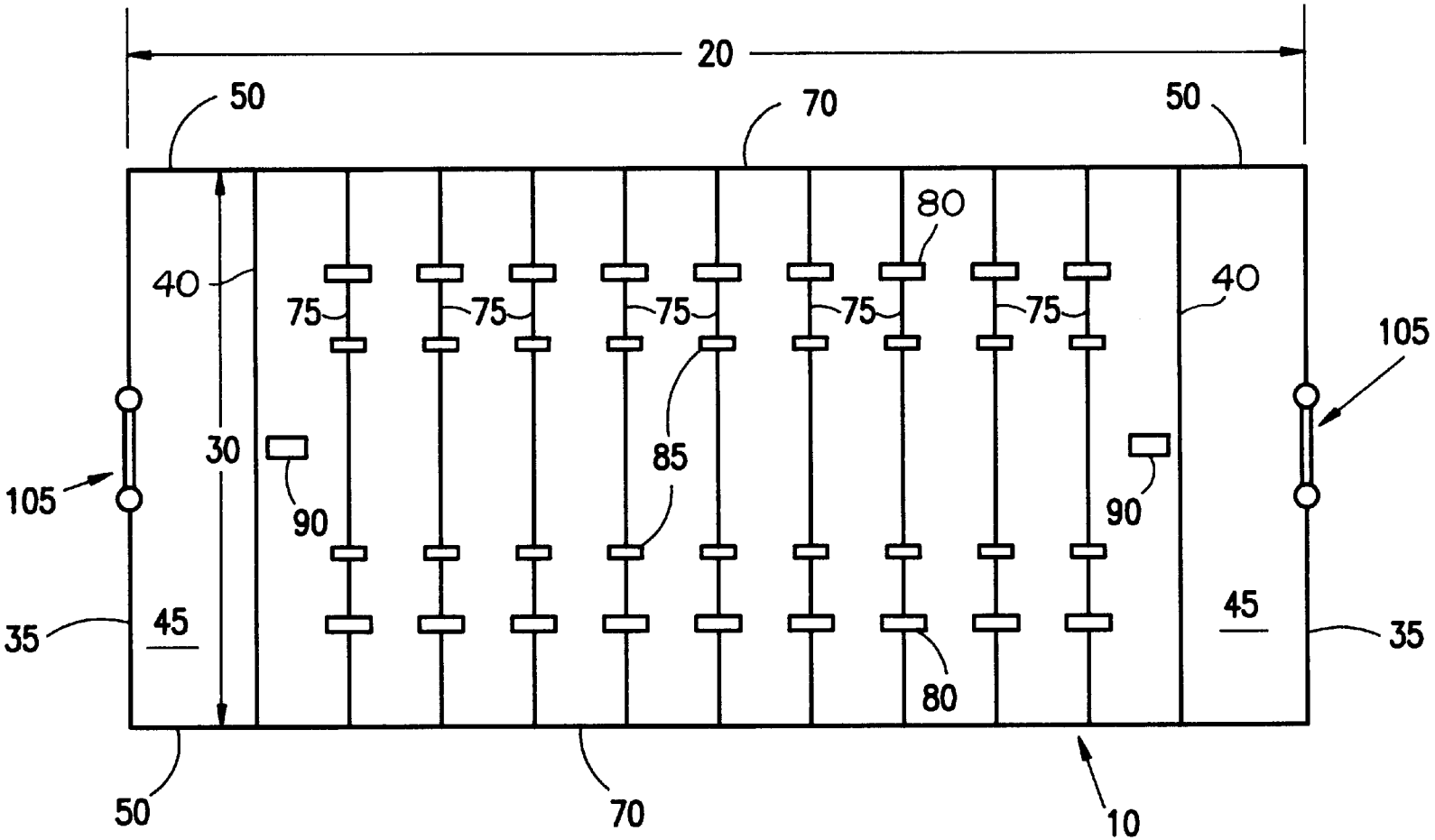
FIG. 2 is a plan view of the playing field of FIG. 1.

Referring to FIGS. 1 and 2, the football game of one embodiment of the present invention is played on a playing field 10 that is preferably rectangular in shape having a total length 20 of approximately sixty-six yards (or 198 feet) and a width 30 that is approximately 28 yards (or 54 feet). The size of playing field 10, which is smaller than an NFL or NCAA playing field, allows the game of the present invention to be played in facilities that are relatively smaller than typical college and professional football stadiums.

Each end of playing field 10 has an end-line 35, with each end-line 35 being substantially parallel to the other. Both end-lines 35 extend the entire width 30 of playing field 10. Positioned approximately eight yards from each end-line 35 toward the opposite end-line 35 are a pair of goal-lines 40. Each goal-line 40 is substantially parallel to its corresponding end-line 35 and extends the entire width 30 of playing field 10. The area between end-line 35 and goal-line 40 forms a goal area 45 at each end of playing field 10. Goal areas 45 are also bordered by a pair of side-lines-of-goal 50 which are substantially parallel to one another and extend from end-line 35 to goal-line 40.

Field-of-play 60 is defined by the area between goal-lines 40. Field-of-play 60 has a length 65 that is preferably fifty yards and a width 30 that is preferably 28 yards. In addition to being bordered by goal-lines 40, field-of-play 60 is also bordered by a pair of substantially parallel side-lines 70 that extend between goal-lines 40. Field-of-play 60 is preferably divided into five yard increments by a plurality of marker-lines 75 that are positioned substantially parallel to goal-lines 40 and that extend the entire width 30 of field-of-play 60 from one side-line 70 to the other. Each marker-line 75 is preferably a strip approximately five to six inches wide.

In the preferred embodiment, a pair of outer hash marks 80, which are typically four inches wide and twelve inches long, are positioned substantially perpendicular to and along each marker-line 75 approximately twenty-nine feet from each side-line 70 and thirteen feet from the center of field-of-play 60. Likewise, a pair of inner hash marks 85, which are preferably the same size as outer hash marks 80, are positioned substantially perpendicular to and along each marker-line 75 approximately thirty-eight feet from each side-line 70 and four feet from the center of field-of-play 60. A point after touchdown ("PAT") hash mark 90, which is preferably the same size as inner hash marks 85, can also be placed substantially parallel to goal-line 40 in the center of field-of-play 60 approximately two yards from each goal-line 40.

In the preferred embodiment, yardage markers (not shown) are placed at each end of marker-lines 75 to indicate the distance of marker lines 75 from the nearest goal-line 40, unless the marker line 75 is equidistant from both goal-lines 40, in which case the yardage markers would indicate the distance from either goal-line 40.

If the facility in which the game of the present invention will be played cannot fully accommodate the size of playing field 10 in its preferred embodiment because of a wall, seating, or any other object, a clear line of demarcation 100 (not shown) is preferably established approximately one foot toward playing field 10 from such obstacle or object. Any player who touches line of demarcation 100, the surface outside of line of demarcation 100, or any object outside of line of demarcation 100 shall be ruled as having out of bounds. Line of demarcation 100 is a feature of the present invention which allows playing field 10 to be adjusted to fit inside many if not most existing sporting facilities (in particular, indoor sporting facilities) so that a wide variety of sports fans can enjoy the excitement of live football.

Figure 3:
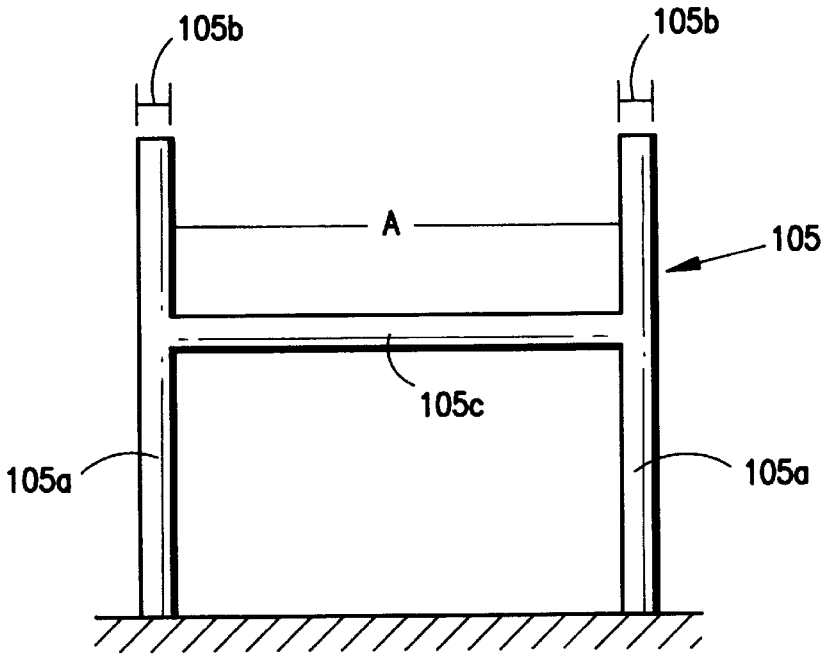
FIG. 3 is a front view of the goalposts.

Now referring to FIGS. 1 and 3, goalposts 105 are preferably centered on each end-line 35. In the preferred embodiment, goalposts 105 are constructed of two vertical posts 105*a*, each having a diameter 105*b* of approximately three or four inches and being spaced apart approximately ten feet, indicated by dimension A. Each vertical post 105*a* extends approximately twenty feet above ground level. Vertical posts 105*a* are joined by a crossbar 105*c* which is substantially parallel to the ground at a height of approximately fifteen feet.

Figure 4:
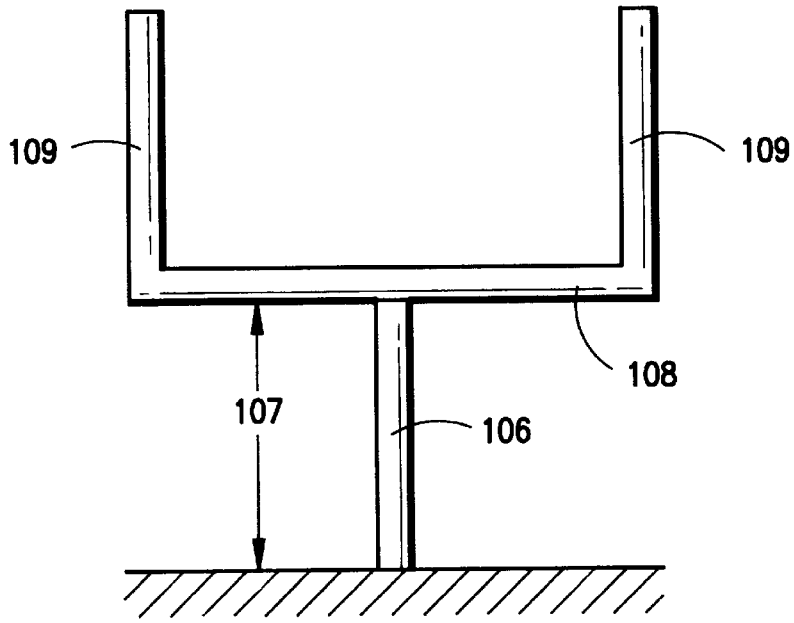
FIG. 4 is a perspective view of another embodiment of the goalposts.

An alternative embodiment of goalpost 105 is illustrated in FIG. 4, where a single vertical post 106, having a height 107 of approximately fifteen feet, is centered along each end-line 35. Centered at the top of vertical post 106 is crossbar 108 which is approximately ten feet wide. Extending vertically from each end of crossbar 108 are vertical posts 109 which are approximately five feet high and are approximately three to four inches in diameter.

In the preferred embodiment of the instant invention, the ball that is used in play is substantially that type used in professional and collegiate football; although various ball dimensions may be used, by way of example the instant invention may be played with an oblong, four panel ball having a long axis length between 11 and 11½ inches; a long axis circumference between 27¾ and 28¼ inches; a short axis circumference between 19⅞ and 20⅛ inches; and a weight between 14 and 15 ounces. Exposed laces should be no more than 4⅜ inches long and 1⅛ inches wide.

Players

In the present invention, the game is played by two opposing teams. Each of the two opposing teams may comprise two eight-man squads: one squad comprising players who will be on the field while that team is on offense, and the other squad comprising players who will be on the field while that team is on defense. Therefore, any given player may take the field only while his team is the team on offense or the team on defense, depending upon that player's position.

The two opposing teams comprise a team on offense and a team on defense, with each team fielding eight players at any given time. As in traditional American football, the team on offense tries to advance the ball down the field to score in the end zone defended by the team on defense.

The eight players of the team on offense preferably comprise a center, two guards, an end, two wide outs, a quarterback and a back.

The team on defense consists of a row of three linemen, a row of three linebackers, and two defensive backs. Defensive linemen principally are responsible for stopping the opposing team's running attack and, in passing situations, putting pressure on the quarterback. The linebackers line up behind the defensive line and, depending on the situation, are used to stop the run attack, pressure the quarterback, or cover the opposition's receivers. The defensive backs cover receivers, offer support in stopping the rushing attack, and also pressure the quarterback.

Sequence of Play, Positioning of Players

At the start of each game, the ball is put in play by a place-kick from the kicking team's goal line. Various rules apply to the kicking sequence, as will be set forth in more detail below. The kicking team lines up at or behind the ball, while the opponents spread out over their territory in a formation devised to help them to catch the ball and run it back effectively. If the kick stays within the boundaries of the field, any player on the receiving team may catch the ball, or pick it up on a bounce, and run with it. As the player runs, the player may be tackled by any opponent and stopped. This is known as being downed.

Play resumes as the team on offense gathers in a circle, called a huddle, and discusses the next play it will use to try to advance the ball. The team on defense also forms a huddle and discusses its next attempt to slow the offense. After the teams come out of their respective huddles, they line up opposite each other on the line of scrimmage.

Play begins when the center crouches over the ball and snaps it to the quarterback. Just prior to the snap, all offensive players are either on the line of scrimmage or in the backfield. The lines of scrimmage are imaginary lines that extend between side-lines 70 through the foremost and rear most points of the football. The area between the lines of scrimmage (the length of the football) is the scrimmage zone. The offensive line of scrimmage is on the team on offense's side of the football, while the defensive line of scrimmage is on the team on defense's side of the football. Both offensive and defensive players are considered to be on their respective lines of scrimmage when they are within one yard of their respective lines.

In the preferred embodiment, there should be at least four offensive players on the line of scrimmage prior to the scrimmage snap; three of whom are ineligible receivers. The ineligible receivers are the center and the two guards who are aligned on either side of the center. In the preferred embodiment, the spacing between the outer shoulders of the two guards is five yards, defining an area referred to as the "alley".

No more than four offensive players can be in the backfield prior to the scrimmage snap. Offensive players are considered in the backfield when any part of their body does not intersect with an imaginary line down parallel to goal lines 40, extending from one side-line 70 to the other, through the waist of the center.

The team on offense may have up to three players in motion and/or moving forward (known as "forward motion") toward their opponent's goal line prior to the scrimmage snap. Forward motion prior to the snap is a feature of the present invention that provides for a faster paced game and increased fan excitement. With the exception of the offensive player(s) in motion, all other offensive players shall remain motionless for a period of at least one second prior to the scrimmage snap.

Just prior to the snap, there must be at least three defensive players on the line of scrimmage aligned head-to-head and shoulder-to-shoulder with the offensive guards. Defensive linebackers should line-up within six yards of the scrimmage zone in the "five yard belt." The "five yard belt" extends from one side-line 70 to the other, five yards behind the defensive line of scrimmage. Defensive players in this belt must align themselves with offensive eligible receivers in set positions at the scrimmage snap. Defensive linebackers do not have to align themselves with the quarterback or with offensive eligible receivers in motion. The remaining defensive players may position themselves anywhere behind the defensive line of scrimmage.

In the game of the present invention, both offensive and defensive players are allowed an unlimited number of substitutions, as long as each team maintains eight players on playing field 10 when the football is in play (unlike the game disclosed in Foster, U.S. Pat. No. 4,911,443, where the teams use a single "platoon" system that requires all players on a given team to play both offense and defense for the duration of the game). In Foster, substitution of players is controlled in that a player must play both offensive and defensive series before being replaced, unless injured for the duration of that half of play.

In the present invention, after the center snaps the ball, the quarterback can pass the ball, hand it off to a teammate, or run with it himself. The offensive players bump the defenders, or try to force them out of the way, by performing a maneuver known as blocking. The defending team tries to prevent the team on offense from advancing the ball by tackling the ball carrier as quickly as possible.

The team on offense shall have a series of four downs to gain a distance of ten yards. If in a series of four downs the team on offense has not gained the required ten yards, the ball shall be awarded to the opponents at the point where the ball became dead. If the required ten yards are gained, a new series is awarded to the team on offense.

A team scores a touchdown when one of its players carries the ball into the opposing team's end zone or catches a pass in the end zone. A touchdown is worth 6 points. After a team has scored a touchdown, it tries for an extra-point conversion (PAT). This is an opportunity to score an additional one or two points with no time elapsing off the game clock. A running or passing conversion in which the ball crosses the goal line counts for two points. A place-kick between the goalposts and over the crossbar counts for one point. A drop kick (described in more detail below) can also be used for the kicking PAT.

Aspects of the Kicking Game

The preferred embodiment of the present invention incorporates apparatus and methods which tailor the kicking aspect of the game to an indoor setting. Certain apparatus which may be employed, along with the layout of the field and the rules governing treatment of kicked balls which travel outside a defined space, provide a unique and novel game.

Several rules, in the preferred embodiment of the game, govern kicking. These include:

- if kicked balls travel out of the back of the receiving's team end zone or grandstands, the ball will be put into play on the receiving team's 25 yard line;
- if kicked balls go out of bounds anywhere inside the opposing team's 25 yard line of play while the ball is in the air, the ball will be put into play on the receiving team's 25 yard line;
- if kicked balls strike any upright assembly in flight, the ball is declared dead and will be put into play on the receiving team's 25 yard line;
- if kicked balls strike any overhanging objects (including the upper boundary surfaces, described in more detail below) above the field of play, the ball is declared dead and will be put into play on the receiving team's 25 yard line;
- if kicked balls hit in the field of play and then: a) exit the end zone, the ball is spotted at the 5 yard line; b) go out of bounds inside the 5 yard line, the ball is spotted at the 5 yard line; c) go out of bounds further upfield than the 5 yard line, the ball is spotted at the point it goes out of bounds.

The aforementioned rules apply to several types of kicks that are contemplated within the present invention. The team on offense may perform a "scrimmage kick" during any one of its plays from scrimmage. The scrimmage kick can be used for a field goal, a point-after-touchdown (PAT), or as a means to place an opponent at a disadvantage in field position (similar to a punt in the NFL or NCAA football). The allowable methods to implement a scrimmage kick are a "place kick" (whereby the ball is kicked after it is placed in a fixed position on the ground, and may be held by a teammate of the kicker); and a "drop kick" (whereby the ball is dropped to the ground and kicked when the ball is rising from the ground or as it touches the ground). A field goal twenty-five yards or longer counts for three points while a field goal of less than twenty-five yards counts for two points.

"Free kicks" are those kicks which place the ball in play at the beginning of each half of play; after a successful field goal, after a convert, and after a safety.

Figure 5:
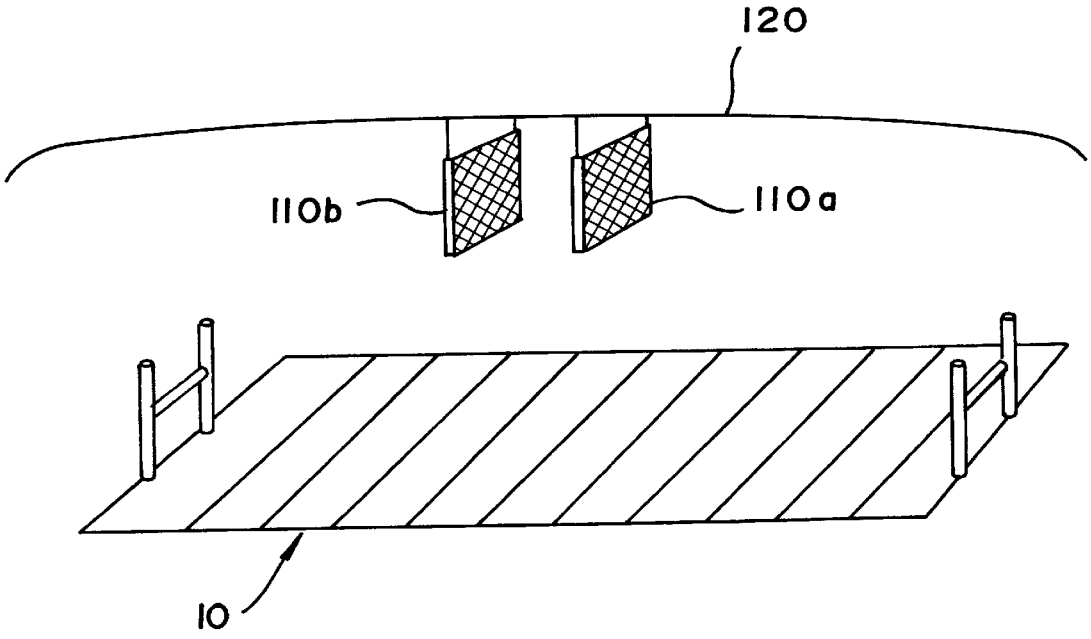
FIG. 5 is a perspective view of the playing field and upper boundary surfaces suspended thereabove.
Figure 6:
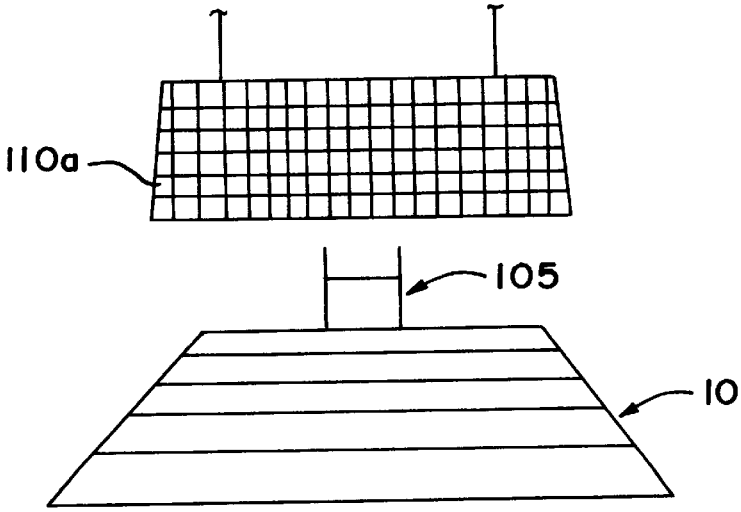
FIG. 6 is a view looking down the playing field from a point near one goal line.

In addition to the boundary lines of the field (which, as described above, define permissible areas for the ball travel), with reference to FIG. 5, the preferred embodiment of the present invention comprises upper boundary surfaces 110*a* and 110*b* which are suspended above playing field 10. Upper boundary surfaces 110*a* and 110*b*, in the preferred embodiment, comprise substantially vertically hanging nets of woven material, and are suspended above and substantially parallel with the 22 and 28 yard lines of playing field 10, and span the width of playing field 10. Upper boundary surfaces 110*a* and 110*b* may be suspended from a rope, cable or other means spanning an open or an enclosed stadium, or may hang from the roof structure or ceiling of a covered playing area, represented in FIG. 5 by structure 120. The bottom edges of upper boundary surfaces 110*a* and 110*b* are substantially horizontal and are approximately 50 feet above the surface of playing field 10. Overall shape and dimensions of upper boundary surfaces 110*a* and 110*b*, in the preferred embodiment, are generally rectangular and 28 yards wide (corresponding to the width of playing field 10) and 10 yards high; however, the exact shape and dimensions, and in particular the height of the boundary surfaces, may be altered to suit particular playing arenas or to create a more restricted vertical playing boundary, even in arenas which may permit a higher playing space. FIG. 6 is another view of the upper boundary surfaces, in particular upper boundary surface 110*a*, looking downfield playing field 10 from a point near one goal line 40.

However, it is to be understood that various materials may be used for the upper boundary surfaces, such as different weaves and materials of netting; resilient sheet material, such as plastic sheeting or the like; or other free-hanging materials which will substantially absorb the energy from a ball striking them, causing the ball to drop to the field below.

Upper boundary surfaces 110*a* and 110*b* may also be placed at different heights above playing field 10, to accommodate different physical settings in which the game of the instant invention may be played, and to provide protection to overhanging score boards and the like which may otherwise be damaged by ball strikes. In addition, the number of upper boundary surfaces may be varied, such as only a single upper boundary surface, or more than two upper boundary surfaces spaced as desired along the length of playing field 10.

As set forth above, balls which strike either of upper boundary surfaces 110 are dead, and are put into play at the receiving team's 25 yard line.

The boundary rules and the upper boundary surfaces serve the purpose of encouraging very precise kicking in the present invention, as the kicker has a relatively short and confined (both on the sides and top) path within which to kick, without incurring the consequences of an out-of-bounds ball and placement of the ball thereafter in a relatively advantageous position on the opponent's side. Such methods and apparatus make the present invention particularly suitable for play in many indoor stadium settings.

In addition to scoring by the team on offense, the preferred embodiment of the present invention also provides for scoring by the team on defense in at least two situations. The first of such situations is a "safety", wherein the team on defense scores two points by causing the team on offense to end a play in possession of the ball behind its (the team on offense's) own goal line. The second of such situations is a "convert try", which arises in the following situation: when the team on offense attempts to score a convert (whether by kicking, passing or running) after scoring a touchdown, and the team on defense gains possession of the ball by fumble recovery, pass interception, or blocked kick recovery before the ball is declared dead, then the team on defense may advance the ball. A convert try, which counts for two points, is scored if the team on defense in such situation successfully advances the ball across the team on offense's goal line.

The team having the most points at the conclusion of the game is declared the winner.

Although the description above contains many specificities, such are intended as examples of presently preferred embodiments and not as limiting the scope of the invention. Various changes and alternative embodiments are possible without departing from the spirit of the invention; for example, different scoring rules could be implemented; field layout and associated equipment could be changed; and the overhead boundary surfaces could be raised or lowered as appropriate to confine kicked and/or passed balls to such heights as are suitable for the particular playing area.

Therefore, the scope of the present invention should not be limited to the above described examples and embodiments but defined by the scope of the appended claims and their legal equivalents.

I claim:

1. A method of playing football on a reduced size playing area, comprising the steps of:

a) providing a generally rectangular playing field having (i) a first end line and a second, opposing end line, a distance between said end lines defining a length of said playing field, (ii) opposing side lines, said opposing side lines defining boundaries of play and a distance between said side lines defining a width of said playing field, and (iii) first and second goal lines parallel to said first and second end lines and spaced inwardly therefrom;

b) providing a generally oblong ball;

c) providing a goal in association with each of said end lines such that said goal defines a scoring area elevated above said playing field;

d) providing a first team of players having as an objective to move said ball across said first goal line, without a player on said first team or said ball moving outside of said boundaries of play, wherein movement of said ball is accomplished by a player on said first team optionally 1) running with said ball, 2) passing said ball to another player on said first team, or 3) kicking said ball through said scoring area;

e) providing a second team of players having as an objective to defend said first goal line by stopping the movement of said ball by said first team toward said first goal line, whereby said movement may be stopped by players of said second team by either optionally 1) tackling a player of said first team who is carrying said ball, 2) disrupting a pass from one player of said first team to another, or 3) disrupting an attempt by said first team to kick said ball through said scoring area;

f) providing said first team with a predetermined number of successive plays to move said ball a predetermined distance wherein each play may be ended when a player on said first team or said ball travels outside said boundary of play, or optionally said second team either 1) tackles a player of said first team who is carrying said ball, 2) disrupts a pass from one player of said first team to another, or 3) disrupts an attempt by said first team to kick said ball through said scoring area; and g) providing at least one upper boundary surface elevated above said playing field, and longitudinally spaced away from said first and second end lines wherein balls which strike said at least one upper boundary surface as a result of said first team's movement of said ball are placed in possession of said second team.

2. The method of playing football of claim 1, wherein said at least one upper boundary surface comprises a generally vertically hanging net.

3. The method of playing football of claim 2, wherein said at least one upper boundary surface comprises a pair of said vertically hanging nets disposed substantially parallel to said end lines, each of said pair having a generally rectangular shape with a width substantially equal to a width of said playing field, each of said pair placed in opposition to one another equidistant from a center of said playing field.

4. The method of playing football of claim 3, wherein a bottom edge of said upper boundary surfaces is no more than 50 feet above said playing field.

5. The method of playing football of claim 4, wherein said length of said playing field is about 198 feet and said width of said playing field is about 84 feet.

6. The method of playing football of claim 1, wherein a distance from each of said scoring areas is defined such that balls which are kicked through said scoring areas from distances greater than said defined distance result in a higher score than do balls kicked through said scoring areas from distances less than said defined distance.

7. The method of playing football of claim 6 wherein said defined distance is 35 yards from each scoring area, and wherein balls kicked through said scoring area from distances greater than said defined distance count for 3 points and balls kicked through said scoring area from distances less than said defined distance count for 2 points.

8. The method of playing football of claim 1, wherein said scoring area is generally rectangular having a width of about 10 feet and a lower boundary elevated about 15 feet above said playing field.

9. The method of playing football of claim 1, wherein each of said first and second teams comprise 8 players on said playing field.

10. The method of playing football of claim 1, wherein in addition to kicking said ball through said scoring area, a player from said first team may also score points by optionally 1) running with said ball over said goal line, or 2) throwing said ball to another player of the same team who catches said ball beyond said goal line or runs over said goal line after catching said ball.

11. The method of playing football of claim 10, wherein after scoring, said first team may score additional points by commencing play with said ball at a predetermined, shortened distance from the goal line and optionally 1) running with said ball over said goal line, 2) throwing said ball to another player of the same team who catches said ball beyond said goal line or runs over said goal line after catching said ball, or 3) kicking said ball through said scoring area.

12. The method of playing football of claim 11, wherein said second team may score by recovering said ball from said first team during said first team's additional scoring attempt, then advancing said ball over said goal line.

* * * * *